United States Patent [19]

Häusermann

[11] 4,267,738

[45] May 19, 1981

[54] TURNING DEVICE ESPECIALLY FOR DRIVING A TURBINE SHAFT

[75] Inventor: Alfred Häusermann, Nussbaumen, Switzerland

[73] Assignee: BBC Brown, Boveri & Co., Ltd., Baden, Switzerland

[21] Appl. No.: 4,185

[22] Filed: Jan. 17, 1979

[30] Foreign Application Priority Data

Feb. 21, 1978 [CH] Switzerland ..... 1841/78

[51] Int. Cl.[3] ..... F16H 57/10; F16H 35/00

[52] U.S. Cl. ..... 74/8; 74/661; 74/850; 74/380; 74/337.5

[58] Field of Search ..... 60/39.14 M, 39.09 R; 74/661, 405, 337.5, 850, 856, 6, 8, 380, 384, 354; 415/1, 20, 19; 192/150

[56] References Cited

U.S. PATENT DOCUMENTS 2,245,175 6/1941 Bany ..... 74/8 X
2,910,894 11/1959 Kenney ..... 74/8 X
3,919,894 11/1975 Keeter et al. ..... 60/39.14 M X
3,927,575 12/1975 Durand ..... 74/380 X

FOREIGN PATENT DOCUMENTS 673329 1/1930 France ..... 74/8

*Primary Examiner*—C. J. Husar
*Assistant Examiner*—Frank McKenzie
*Attorney, Agent, or Firm*—Burns, Doane, Swecker & Mathis

[57] ABSTRACT

A turning device preferably for turbine-machines is disclosed having a turning-gear pinion arranged on a cam so that the axes of rotation of the cam, the turning-gear pinion and the shaft to be turned are aligned in a central line. To turn the shaft, the turning-gear pinion is caused to engage a toothed ring of the shaft by a hydraulic piston acting on the cam. The turning-gear piston is then held in the engaged position by a spring-loaded pressure cylinder which engages a catch of the cam. When a certain speed has been reached, or when the shaft is turning backward, the spring loaded pressure cylinder becomes disengaged from the catch and the turning-gear pinion swings out sideways.

14 Claims, 2 Drawing Figures

TURNING DEVICE ESPECIALLY FOR DRIVING A TURBINE SHAFT

BACKGROUND AND SUMMARY OF THE PRESENT INVENTION

The present invention relates generally to a turning device for turbine-machines.

Rotating machines which are shut down, especially turbines, and that require a relatively long period of time after shut down to cool off, must be kept slowly rotating in order to prevent any warping of the shaft. Furthermore, the re-starting of large turbines requires that the inertia of the shaft be overcome preferably in a manner which insures a smooth start up of the rotor. Various auxiliary turning systems are being employed both for the continuous rotation of the rotor after shut-down as well as for the start-up of the turbine.

In the case of small and medium-sized turbine-units, turning gears having pinions have been used, with turning-gear pinion arranged non-symmetrically with respect to the longitudinal axis of the turbine shaft (see especially publication 7002 by "BHS-Getriebetechnik"). Such a known arrangement has the disadvantage, however, that the gearing must be cut in and engaged manually when the turbine-unit is at a standstill. Furthermore, during a reverse rotation of the turbine-units such as during use as a compressor and as pump drives and also when the compressor and the turbine coupled to it are driven in reverse, for example, due to a counter-flow of compresssed air or gases, the gearing of the known arrangements will also run backward and likely become damaged in the process.

It is a particular object of the present invention to provide a turning device which permits both a forward as well as a reverse rotation of the turbine-unit so that the turning device can be used in various systems, for example for both compressor and pump drives, without any damage to the turning gear and pinion arrangement.

The present invention solves the problems described above in that a hydraulic piston causes a turning-gear pinion that is arranged at a cam to engage a toothed ring arranged at the shaft to be turned. The cam carries a catch, into which catch a pressure cylinder is locked, thereby keeping the cam and the turning gear pinion in an engaged position. Additional devices are provided at the cam to hold the turning-gear pinion in a swing-out position. It is advantageous if the cam has a smaller radius at one side of the catch, and a larger radius at an opposite side of the catch so that the swing-out of the turning-gear pinion during a forward movement of the turbine shaft requires a relatively smaller release force. The swingout of the turning-gear pinion during a reverse movement of the turbine shaft will accordingly require a relatively greater release force. A spring-loaded leg is preferably hinged to the cam in order to hold the turning-gear pinion in place.

The rotary axis of the turning gear pinion is preferably arranged so as to lie within a line extending between the two turning points of the turbine shaft and of the cam. The cam is held in the position of engagement with the toothed ring of the turbine shaft both by a spring-loaded pressure cylinder which engages the asymmetrically formed catch of the cam, and also by a spring-loaded leg extending along the rotational axis of the cam. Accordingly, the pinion will be able to swing out toward either side. The asymmetric form of the catch for the pressure cylinder, which is due to the fact that the cam has dissimilar radii on either side of the catch, has the result that a smaller release force will be required for swinging the turning-gear pinion in the forward direction of rotation of the turbine shaft while a greater release force must be used for swinging the pinion in a direction against the normal direction of rotation, for example when the direction of the turbine shaft is reversed. The cam will thus also perform a safety function since when the torque during the start-up becomes excessive, or when the turbine shaft is turning backward, the turning-gear pinion, actuated by the cam, will become disengaged.

The turning device of the present invention can be further improved by actuating the device by a hydraulic piston in such a manner that the hydraulic piston will move the cam only into a position of engagement with the turning-gear pinion. The pinion is then held in the engaged position by the spring-loaded cylinder.

BRIEF DESCRIPTION OF THE DRAWINGS

A preferred embodiment of the present invention is described with reference to the appended drawings wherein like members bear like reference numerals and wherein.

DETAILED DESCRIPTION OF A PREFERRED EMBODIMENT

Figure 1:
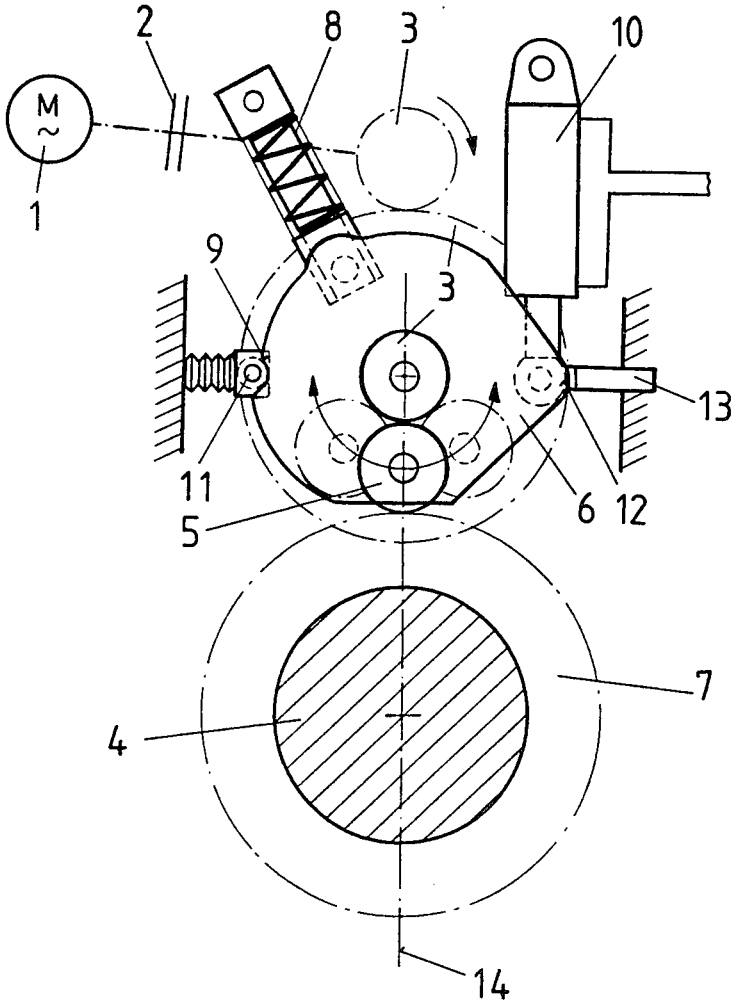
FIG. 1 is a schematic illustration of a turning device according to the present invention.

With reference to FIG. 1, a preferred embodiment of the present invention includes a drive motor, preferably an electro-motor, which is operatively connected with a transmission gear train 3 (partially illustrated in schematic by dashed lines) by a coupling 2 which can be arranged in the form of a mechanical coupling or a hydraulic flow coupling. The transmission gear train 3 drivingly engages a turning-gear pinion 5 which drives the turbine shaft 4 by way of a toothed ring 7 (illustrated in schematic by a dashed line). The turning-gear pinion 5 is rotatably mounted on a cam 6. The cam 6 carries a catch 9 which is engaged by a spring-loaded pressure cylinder 11. A hydraulic piston 10 engages the cam 6 at a side which is opposite to the catch 9. A spring-loaded leg 8, pivotably attached to the cam 6 keeps the cam 6 and the turning-gear pinion 5 in place at either of two swing-out positions. The cam 6 is further provided with a projection or lifter 12 which actuates a terminal switch 13 to signal the hydraulic piston, 10 when a certain position of the cam 6 has been reached.

Figure 2:
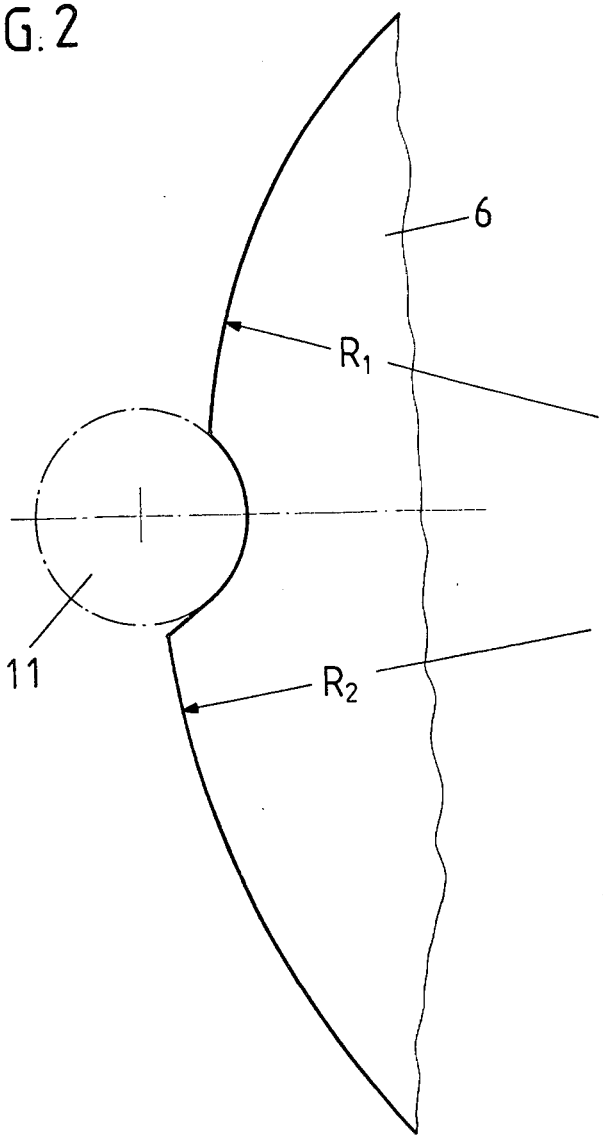
FIG. 2 is an enlarged view of a portion of the turning device of FIG. 1.

With reference to FIG. 2, the cam 6 has a smaller radius $R_1$ at one side of the catch 9, and a larger radius $R_2$ at the other side of the catch 9.

The turning device according to the present invention operates as follows:

To start the turbine after a standstill of the turbine shaft 4 or to continuously turn the turbine shaft during a cooling-off period, the hydraulic piston 10 is actuated by way of a valve (not illustrated) so that the turning-gear pinion 5, arranged at the cam 6, engages the toothed ring 7 of the turbine shaft 4. The ends of the axes of rotation of the cam 6, the turning-gear pinion 5 and the turbine shaft 4 thereby form a central line 14 with the axes all lying within a common plane. When the cam 6 has reached the position of alignment with the axes of rotation of the cam 6, and the turbine shaft 4, the lifter 12 actuates the terminal switch 13 which starts the drive motor 1 and then unloads the hydraulic piston. When the turbine has reached a certain speed, that is when the speed of the turbine shaft 4 exceeds the designed speed of the turning-gear pinion 5, (in other words when the over-riding force of the rotating turbine is greater than the loading force of the spring pressure provided by the pressure cylinder 11 and the spring loaded leg 8), the turning-gear pinion 5 will swingout laterally, (to the right in the drawing), whereby the terminal switch 13 will cut off the drive motor 1.

If the turbine shaft 4 should turn backward, the turning-gear pinion 5 will swing out (to the left in the drawing) because the backward release force provided by the turbine will be greater than the break-away force required as a result of the greater radius $R_2$ of the cam 6.

The arrangement of the present invention also prevents an overspeeding by the turning apparatus since the cam 6 will then swing out (to the left in the drawing) when the driving force of the turning device sufficiently exceeds the force of resistance to turning of the turbine shaft 4. The driving force must exceed the force of resistance by an amount great enough to cause the pressure cylinder 11 to ride over the radius $R_2$ of the cam 6.

If at the time of activating the turning apparatus the teeth of the toothed ring 7 and the teeth of the turning-gear pinion 5 should stand opposite to each other, the hydraulic piston 10 may be unloaded again. A brief current pulse is then given to the drive motor 1 so that the pinion 5 will spin for a brief period of time and swing out relative to the toothed ring 7. The hydraulic piston 10 is then actuated again and the starting process is repeated. For the purpose of attaining an elastic starting characteristic, it will be expedient to arrange the coupling 2 in the form of a hydraulic flow coupling.

The springloaded leg 8 is preferably arranged so that the leg 8 is radial with respect to the central axis of the cam 6 when the pinion 5 engages the toothed ring 7. In this way, the springloaded leg 8 will urge the cam to rotate when the cam swings out but the leg 8 will not provide a rotating force on the cam when the pinion 5 is in engagement with the toothed gear. In other words, the spring loaded leg 8 acts radially on the cam 6 when the central axis of the pinion 5 is aligned with the central axis of the cam 6 and the shaft 4.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A turning device for driving a rotatable member especially a turbine shaft, comprising:

a cam member supporting a pinion gear, said cam member being mounted adjacent said rotatable member for swinging movement forward and backward relative to said rotatable member;

drive means for selectively driving said pinion gear;

first means for urging the pinion gear into operative engagement with the rotatable member by swinging said cam member to an intermediate position, said intermediate position being between extremes of said foreward and backward swinging movement of said cam member;

second means for releasably maintaining the pinion gear in said operative engagement with the rotatable member; and third means for swinging said cam member out of said intermediate position upon a release of said second means.

2. The turning device of claim 1 wherein the pinion gear operatively engages a toothed ring of the rotatable member.

3. The turning device of claim 1 wherein the first means includes a hydraulic piston pivotably connected at one end to the cam member.

4. The turning device of claim 1 wherein the second means includes a catch carried by the cam member and wherein a resilient member engages the catch.

5. The turning device of claim 4 wherein the resilient member includes a pressure cylinder.

6. The turning device of claim 1 wherein the cam member is rotatably mounted on a central axis of the cam member.

7. The turning device of claim 6 wherein the pinion gear operatively engages a toothed ring of the rotatable member and wherein the central axis of the cam member is parallel to a central axis of the rotatable member with a central axis of the pinion gear being coplanar with the central axes of the cam member and the rotatable member when the pinion gear is in the operative engagement with the rotatable member.

8. The turning device of claim 4 wherein the cam member is rotatably mounted on a central axis and wherein the cam member has a smaller radius at one side of the catch and a larger radius at the other side of the catch so that a force needed to urge the resilient member out of engagement with the catch is greater in one direction of rotation of the cam member than in the other direction of rotation of the cam member.

9. The turning device of claim 1 wherein the drive means includes a drive motor having a hydraulic coupling with the pinion gear.

10. The turning device of claim 1 further comprising switch first means.

11. The turning device of claim 10 wherein the switch means also controls the drive means.

12. The turning device of claim 1 wherein the third means includes a leg member having a spring, the leg member pivotably connected to the cam member.

13. The turning device of claim 12 wherein the leg member is radially aligned with the central axis of the cam member when the pinion gear is in engagement with the rotatable member.

14. A turning device for driving a rotatable member especially a turbine shaft, comprising:

a cam member supporting a pinion gear, said cam member being mounted adjacent said rotatable member for swinging movement forward and backward relative to said rotatable member;

drive means for selectively driving said pinion gear, said drive means including a drive motor and a coupling;

first means for urging the pinion gear into operative engagement with the rotatable member by swinging said cam member to an intermediate position, said intermediate position being between extremes of said forward and backward swinging movement of said cam member;

second means for releasably maintaining the pinion gear in said operative engagement with the rotatable member, said second means including a pressure cylinder which selectively engages the cam member; and third means for swinging said cam member out of said intermediate position upon a release of said second means.

* * * * *